US006360894B1

(12) United States Patent
Devlin et al.

(10) Patent No.: US 6,360,894 B1
(45) Date of Patent: Mar. 26, 2002

(54) DOUBLE SKIN TROMMEL

(75) Inventors: Tony Devlin, Coalisland; Ronnie Kerr; David Lyons, both of Omagh; Richard Byrne, Dungannon, all of (GB)

(73) Assignee: Finlay Hydrascreens Ltd., Tyrone (GB)

( * ) Notice: Subject to any disclaimer, the term of this patent is extended or adjusted under 35 U.S.C. 154(b) by 0 days.

(21) Appl. No.: 09/653,238

(22) Filed: Aug. 31, 2000

Related U.S. Application Data

(60) Provisional application No. 60/151,728, filed on Aug. 31, 1999.

(51) Int. Cl.[7] ..... B07B 1/22
(52) U.S. Cl. ..... 209/291
(58) Field of Search ..... 209/288, 289, 209/290, 291

(56) References Cited

U.S. PATENT DOCUMENTS

| | | | | | |
|---|---|---|---|---|---|
| 308,584 | A | | 11/1884 | Van Derveer | |
| 364,927 | A | * | 6/1887 | Hogeboom | |
| 896,891 | A | * | 8/1908 | Campbell | |
| 1,336,963 | A | | 4/1920 | Keables | |
| 1,441,812 | A | * | 1/1923 | Landrichinger | |
| 1,473,745 | A | * | 11/1923 | Stedman | |
| 3,670,882 | A | * | 6/1972 | Conrad et al. | 209/2 |
| 3,756,406 | A | | 9/1973 | Khan | 209/291 |
| 4,119,534 | A | | 10/1978 | Porter et al. | 209/291 |
| 4,159,242 | A | | 6/1979 | Walker | 209/44 |
| 4,167,975 | A | * | 9/1979 | Fahrenholz | 171/12 |
| 4,303,506 | A | | 12/1981 | Finlay | 209/247 |
| 4,533,053 | A | * | 8/1985 | Kenny et al. | 209/636 |
| 4,880,539 | A | * | 11/1989 | Crawford et al. | 210/408 |
| 4,983,280 | A | * | 1/1991 | Eriksson | 209/241 |
| 5,009,370 | A | | 4/1991 | Mackenzie | 241/24 |
| 5,022,982 | A | | 6/1991 | Greeley | 209/12 |
| RE34,458 | E | * | 11/1993 | Fahrenholz | 241/74 |
| 5,285,905 | A | | 2/1994 | Laprade | 209/288 |
| 5,346,071 | A | | 9/1994 | Page et al. | 209/257 |
| 5,433,849 | A | * | 7/1995 | Zittel | 210/324 |
| 5,456,364 | A | | 10/1995 | Lambert | 209/382 |
| 5,474,186 | A | * | 12/1995 | Fulghum, Jr. et al. | 209/291 |
| 5,570,790 | A | | 11/1996 | Rumpf et al. | 209/291 |
| 5,819,950 | A | | 10/1998 | McCloskey | 209/241 |
| 6,006,921 | A | * | 12/1999 | Zehr | 209/288 |

* cited by examiner

*Primary Examiner*—Donald P. Walsh
*Assistant Examiner*—Mark J. Beauchaine
(74) *Attorney, Agent, or Firm*—Moser, Patterson & Sheridan, LLP

(57) ABSTRACT

A double skin trommel having an inner drum and an outer drum joined together to rotate. Material is fed into one end of the inner drum, where some passes through apertures therein and the rest moves to the opening at the opposite end and is discharged as oversize material to a stockpile. Material that passes through the apertures is received in the outer drum which has roller mesh screen panels around a helical discharge spiral. Material that is smaller than the opening in the mesh passes through onto a conveyor and that fines grade material is stockpiled. The material that is retained in the outer drum is moved by the spiral to the discharge end of the drum and that middle grade material is conveyed to a stockpile. The apparatus is transportable being mounted on a chassis.

10 Claims, 6 Drawing Sheets

DOUBLE SKIN TROMMEL

CROSS-REFERENCE TO RELATED APPLICATIONS

This application claims priority to U.S. Provisional Patent Application Ser. No. 60/151,728 filed Aug. 31, 1999 and is herein incorporated by reference.

BACKGROUND OF THE DISCLOSURE

1. Field of the Invention

The invention relates machinery for automatically separating large quantities of unconsolidated material (i.e., construction or demolition debris, mined material, soils, recyclable material and the like). More particularly, the invention relates to a mobile trommel having multiple screening steps for easier and more refined separation of various grades of the unconsolidated material into at least three separate grades.

2. Description of the Background Art

Various industries require machinery that can mechanically separate unconsolidated material into different grades of consolidated material. For example, the demolition of a structure (i.e., masonry or block construction, or the like) produces a large quantity of rubble. Such rubble may sometimes have to be separated by size for use in backfilling or for proper carting and processing at a remote location. In mining operations it is necessary to process large amounts of material extracted from a mine and separate the ore from soil, rock and other non-valuable material. In the landscaping and gardening industries, it is necessary to produce various grades of fill material to suit specific purposes. Compost, mulch and finer grades of topsoil must be separated from bulk quantities of collected biodegradable refuse. Such materials are then distributed throughout a particular landscaping project dependent upon specific need.

In each instance and industry discussed above, large quantities of differently sized materials need to be separated. Performing such separation task by hand is slow, tedious and usually unprofitable for an operator of a business operating within such industry. Therefore, mechanical separators were developed to solve this problem.

Typically, one drum receives material to be separated, and the drum, which is provided with perforations or other such openings, is rotated to cause a mixing action of the material. The perforations in conjunction with the rotating action allow some material (smaller than the openings) to pass radially out of the drum for collection and further processing. Material that does not meet the size criteria is moved by gravity to the lower end of the drum and is carried away as waste. Unfortunately, only two grades of materials can be separated from such a single drum device (waste and processed material).

Therefore, a need exists in the art for a mechanical separator or trommel that is capable of separating raw material into more than two grades of materials.

SUMMARY OF THE INVENTION

A transportable trommel for separating mixtures of soils, debris, recyclable material or the like into three grades according to particle or grain size. The trommel is double skinned and has an inner drum with apertures of a first predetermined size and an outer drum with screens having openings in their mesh of a second predetermined size.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
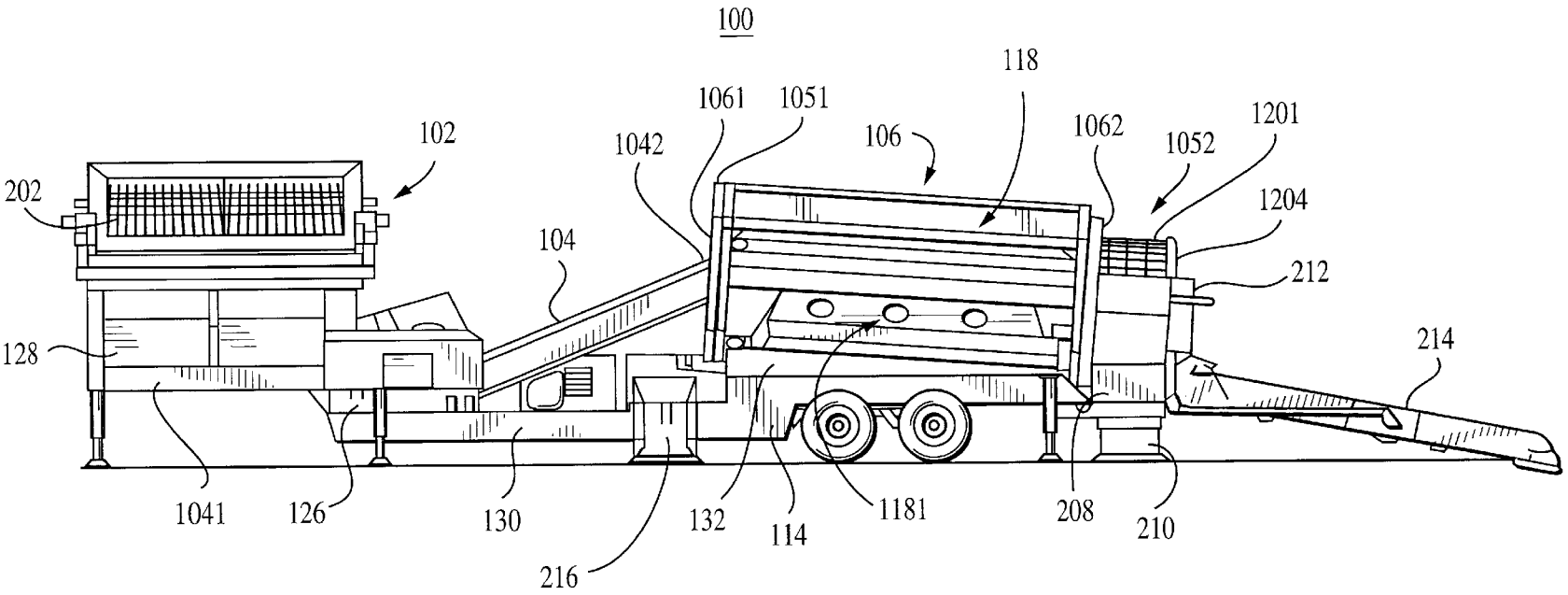
FIG. 1 depicts an elevation view of the subject invention.
Figure 2:
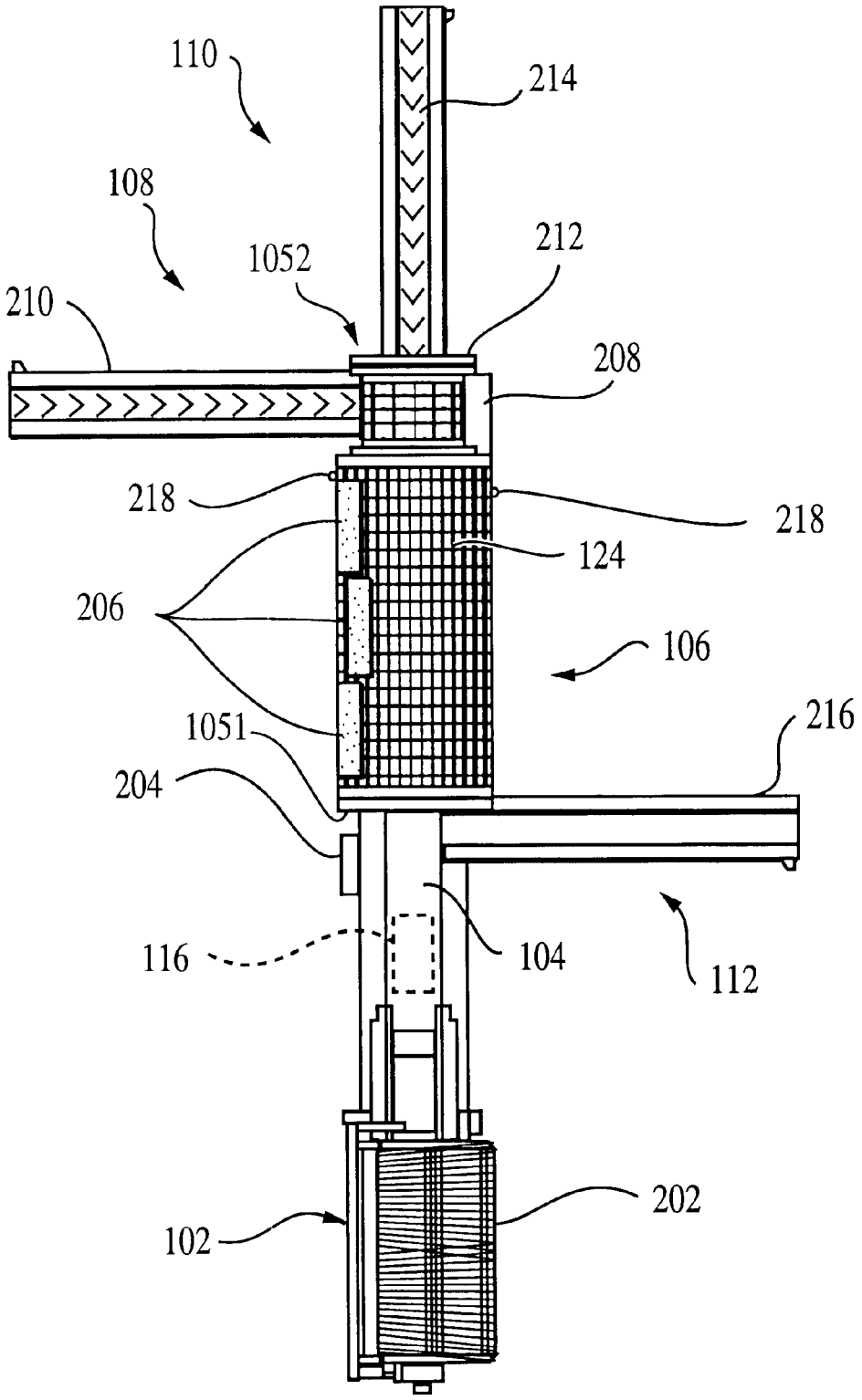
FIG. 2 depicts a top view of the subject invention.

After considering the following description, those skilled in the art will clearly realize that the teachings of the invention can be readily utilized in applications for separating large quantities of raw, unconsolidated material (i.e., earthborn debris, fill and the like) into various grades of consolidated material. Specifically, FIG. 1 and FIG. 2 depict, respectively, an elevation view and a top view of a large scale, transportable mechanical separator or trommel 100. The trommel 100 comprises a hopper 102, a feed conveyor 104, a double skin trommel barrel 106 and a plurality of grade conveyors 108, 110 and 112. The trommel 100 is mounted on a rolling chassis 114. Such chassis 114 facilitates transport of the trommel 100 to remote locations where the apparatus is needed.

The reader is directed to view both FIG. 1 and FIG. 2 while reading the following description of the invention. FIG. 2 depicts a top view of the trommel 100 when ready for use. The hopper 102, commonly known as the beltfeed hopper, further comprises a bin 128 and a reject grid 202 disposed over the bin 128. The grid 202 is approximately 12'×5'and is fitted with a hydraulic actuator (not shown) to tip the grid 202 as described in greater detail below. The bin 128 is capable of receiving approximately 11 cubic yards of material, which drops onto a collection belt 1041 that conveys the unconsolidated material to the feed conveyor 104. The feed conveyor 104 is approximately 3' wide and is mounted to a beltfeeder chassis portion 130. A feed conveyor drive assembly 126 is disposed on the chassis 114 proximate the hopper 102 and serves to feed material to the double skin trommel barrel 106 which has a receiving end 1051 and a discharge end 1052. The feed conveyor drive assembly 126 is mechanically coupled to the feed conveyor 104 and collection belt 1041 to provide movement of material on the conveyor belts accordingly. Material received on the collection belt 1041 beneath the hopper 102 goes onto the feed conveyor 104 that inclines away from the hopper 102 and up toward the double skin trommel barrel 106 at its receiving end 1051. An upper portion 1042 of the feed conveyor 104 extends preferably into an inlet opening 1061 at the receiving end 1051 of the double skin trommel barrel 106. By these conveyors means, or their equivalent, the unconsolidated material of varying grain and particle size is conveyed to the trommel barrel.

The double skin trommel barrel 106 is housed in a trommel guard 118. The trommel guard 118 is supported by a trommel mounting frame 132 disposed above the chassis 114. The trommel barrel inlet opening 1061 is sized for receiving unconsolidated material to be separated into three grades according to the particle and grain size of the mixed material. The trommel guard 118 is a housing that encloses most of the double skin trommel barrel 106 so that only about an upper ⅓ of the barrel is not enclosed. The trommel guard housing serves to contain material being separated within the double skin trommel barrel and to help channel some of the screened material along its flow path and down to fines grade transfer conveyor. The trommel guard 118 has a plurality of covers on hinges 218 for ease of access to the double skin trommel barrel 106. The sides of the trommel guard, alongside the double skin trommel barrel, may be fitted with rubber curtains (not shown) and access ports 1181 through which the curtains can be shaken manually to free material that may build up between the trommel guard sides and the trommel barrel. A plurality of cleaning brushes 206 are disposed on the trommel guard 118 to contact with the outside of the double skin trommel barrel 106 upon the exposed ⅓ portion, previously described. In a preferred embodiment of the invention, there are three (3) brushes fabricated from nylon. The brushes 206 are explained in greater detail below. A drive assembly 134 is disposed in the trommel mounting frame 132. The drive assembly 134 (explained in greater detail below) is adapted for rotational movement of the double skin trommel barrel 106.

Figure 3:
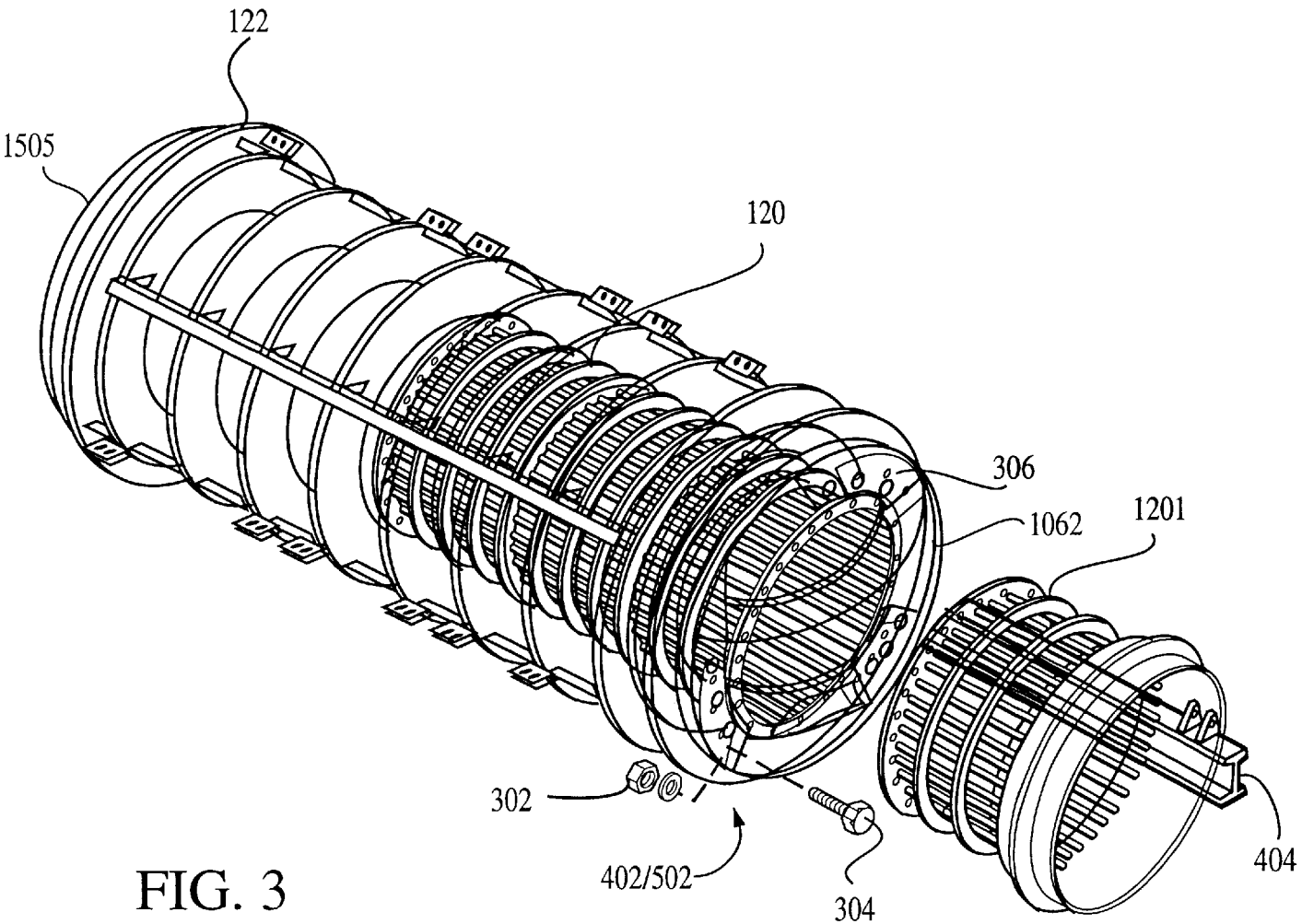
FIG. 3 depicts a partial cutaway, perspective view of the double-wall drum assembly of the subject invention.
Figure 6:
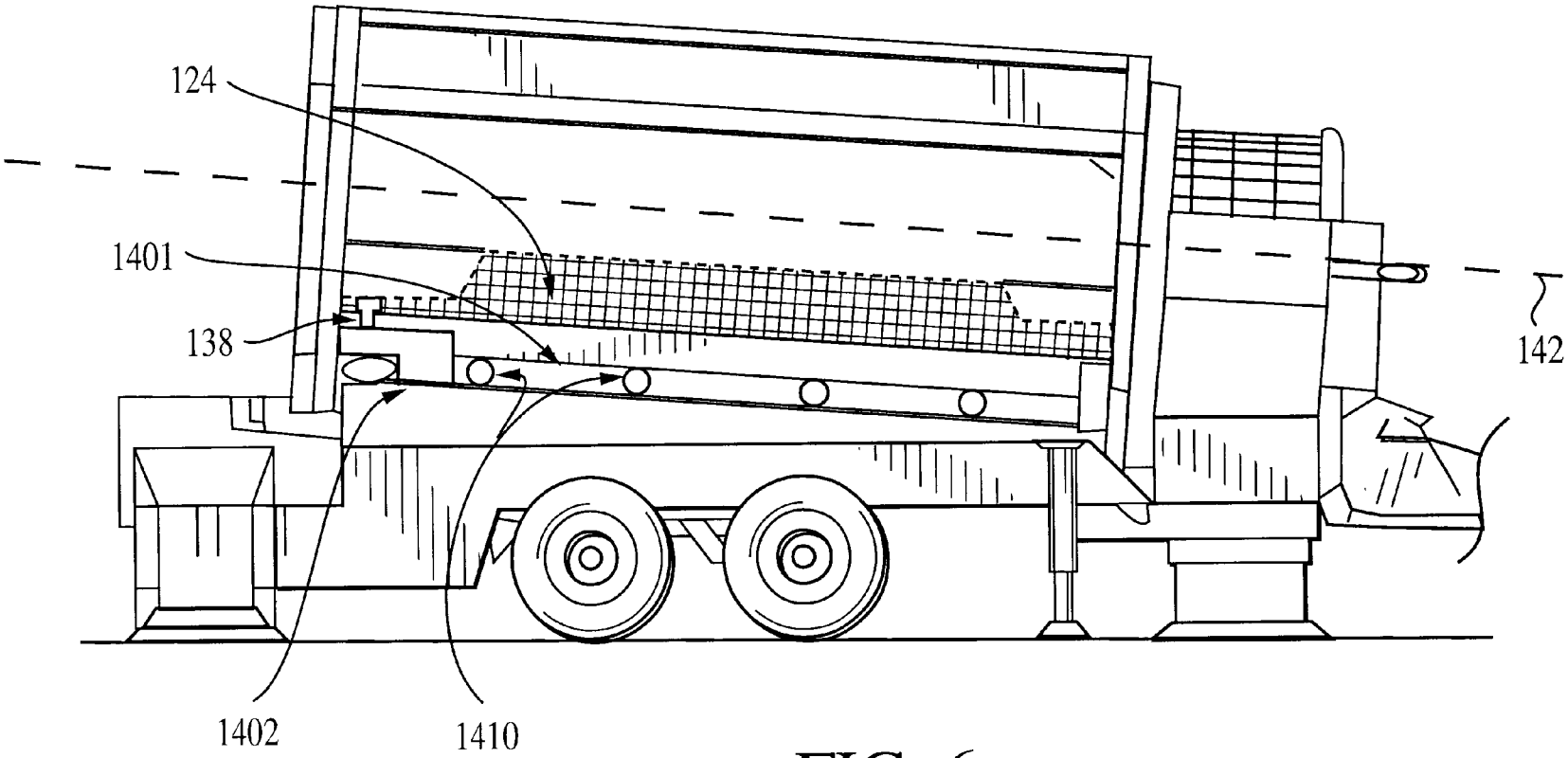
FIG. 6 depicts a partial view of the trommel barrel with a cutaway portion to show internal parts.

As shown in FIG. 3, the double skin trommel barrel 106 further comprises an inner drum 120 and an outer drum 122 that are bolted together. Additionally, and as seen in FIG. 6, a roller mesh screen layer comprised of a plurality of mesh screens 124 is disposed over the outer drum 122. The inner drum 120 and outer drum 122 are preferably concentric and co-axial with respect to one another. The double skin trommel barrel is retained in an axial position within the trommel guard 118 via a set of rollers 138. That is, rollers 138 (preferably four) are disposed at the bottom of the trommel guard 118 and contact the outer drum 122 at a plurality of troughs or channels 140. The rollers 138 spin thereby allowing the double skin trommel barrel 106 to rotate on a central axis 142 yet not "ride" translationally along said axis. Additionally, the trommel guard 118 and double skin trommel barrel preferably are maintained at a set angle of 4 degrees with reference to the chassis 114, with the receiving end 1051 being elevated above the discharge end 1052.

The double skin trommel barrel 106 is flanked by the plurality of grade conveyor assemblies 108, 110 and 112 that extend from the trommel chassis to the surface of the working area around the device. Specifically, a medium or middle grade conveyor assembly 108 is disposed at the discharge end 1052 of the double skin trommel barrel 106 proximate to the discharge outlets 1062 of the outer drum. The middle grade conveyor assembly 108 further comprises a middle grade hopper 208 attached to the trommel mounting frame 132 and a power-driven middle grade conveyor 210 extending from the middle grade hopper 208. In the preferred embodiment, the middle grade conveyor extends laterally away from one side of the trommel mounting frame. The middle grade conveyor 210 uses for example an approximately 24" wide heavy duty chevron belt. An oversize or coarse grade conveyor assembly 110 is disposed at the discharge end of the trommel beyond the middle grade hopper 208 and below an outlet end 1204 of the inner drum. Similar to the middle grade conveyor assembly 108, the coarse grade conveyor assembly 110 further comprises a coarse grade hopper 212 attached to the trommel mounting frame 132 proximate to the outlet end of the extended portion 1201 of the inner drum and a coarse grade conveyor 214 extending from the coarse grade hopper 212. In the preferred embodiment, the coarse grade conveyor extends directly out from the discharge end of the double skin trommel barrel 106 to convey oversize material to a working pile. The coarse grade conveyor 214 is for example an approximately 39" wide heavy duty chevron belt. A fines grade conveyor assembly 112 comprises a transfer conveyor 1401 disposed upon conveyor rollers 1410 under the double skin trommel barrel 106. More specifically and as seen in FIG. 6, the fines grade transfer conveyor is disposed below the outer drum within the sides of the trommel guard 118 on the chassis portion 130 of the trommel mounting frame 132. The fines grade conveyor assembly 112 further comprises a fines grade feedboot 1402 that gathers the fines grade material received from the transfer conveyor and directs that to the fines grade conveyor 216 that in the preferred embodiment extends laterally from one side of the double skin trommel barrel 106. In the preferred embodiment, the fines grade conveyor 216 is motor driven and uses for example an approximately 29.5" wide heavy duty belt. Each discharge conveyor 210, 214 and 216 preferably is adapted to be raised and lowered hydraulically and to be folded into a transport position from the working position shown in FIG. 1. In their working position, the conveyors 210, 214 and 216 extend laterally from the trommel to convey the separated oversize, middle and fines grades of material to separate working piles.

A control panel 204 for controlling the functions of the trommel 100 is disposed proximate the central portion of the double skin trommel barrel 106. A power unit 116 is disposed in the beltfeeder chassis portion 130 and provides power to the trommel 100. For example, the power unit can be a diesel engine coupled to hydraulic pumps. In a preferred embodiment of the invention, the power unit comprises, in part, a Deutz Bf4L turbo diesel engine capable of producing 90 hp. Such engine is controlled via the control panel 204 which actuates various hydraulic pumps and/or pump circuits to cause the trommel to perform its various functions (i.e., controlling the folding and unfolding of the conveyors as discussed above).

Figure 4:
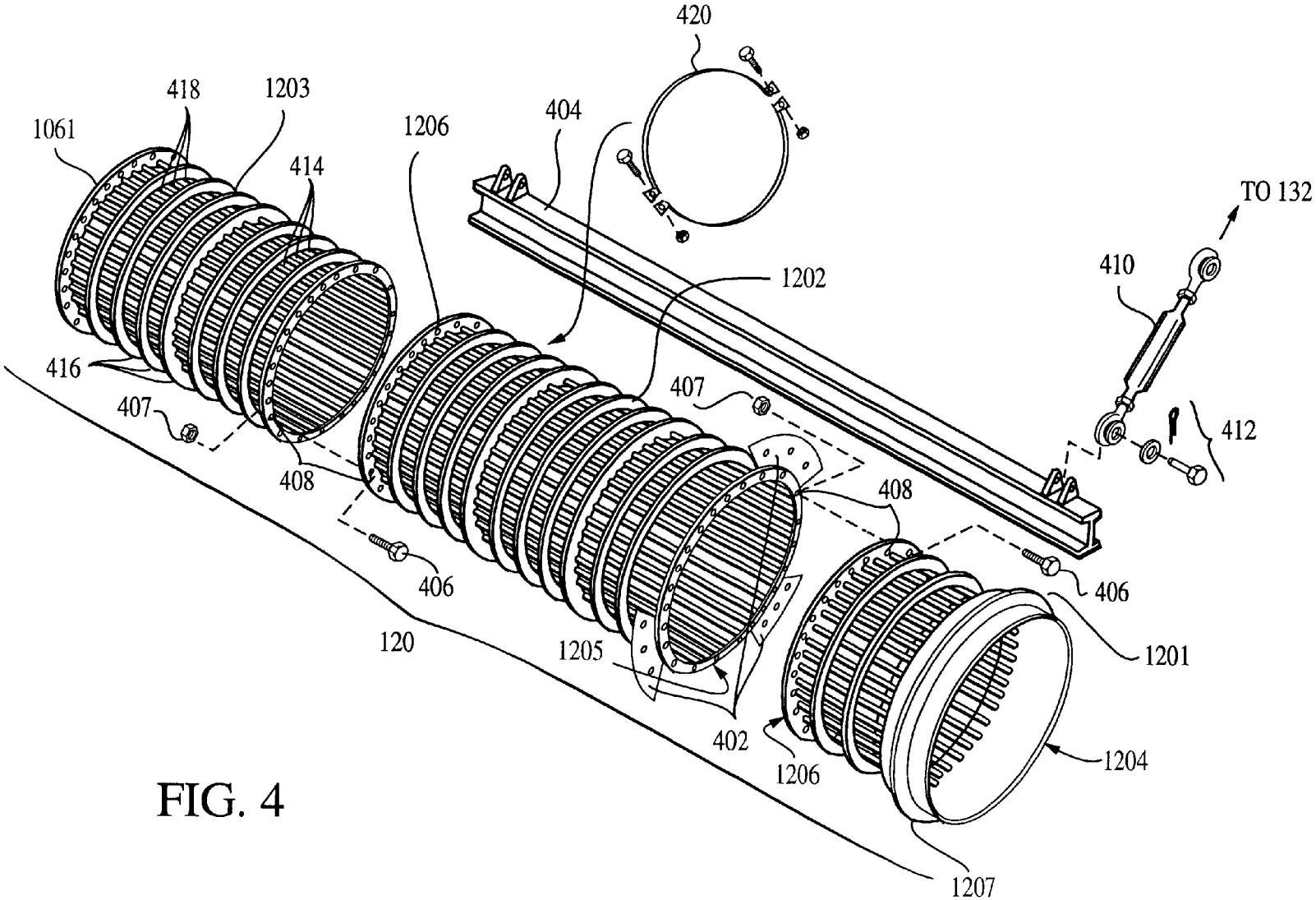
FIG. 4 depicts an exploded perspective view of the inner drum of the subject invention.
Figure 5:
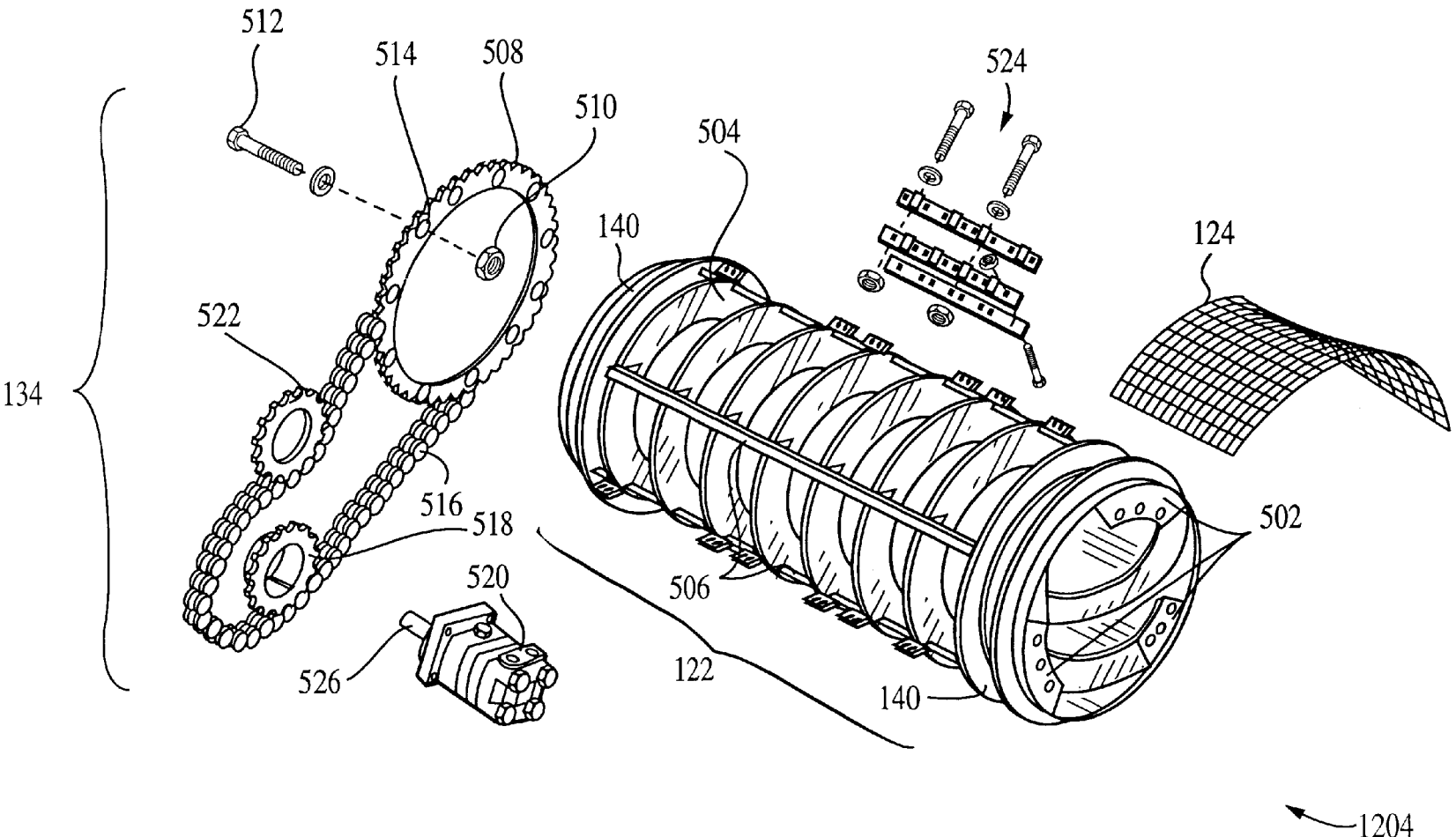
FIG. 5 depicts an exploded perspective view of the outer drum of the subject invention.

FIG. 3 depicts a partial cutaway, perspective view of the double skin trommel barrel 106. FIG. 4 depicts an exploded perspective view of the inner drum 120. FIG. 5 depicts an exploded perspective view of the outer drum 122. The reader is directed to each of these FIGs simultaneously while reading this written disclosure. The inner drum 120 comprises a plurality of longitudinally arranged members 414 crossed by a plurality of radial members 416 as seen in FIG. 4. In the preferred embodiment, these cross members form a cylinder with a cage-like structure that provide multiple surface areas that break apart the unconsolidated mix of material, and this embodiment is preferred over a drum with a smoother surface and perforated openings. The cross-member construction of the members 414 and 416 defines apertures of a first predetermined size that have a generally rectangular shape in the preferred embodiment. The longitudinally arranged members 414 are attached to the plurality of radial members 416 by any conventional means such as welding to form a cylinder having a plurality of apertures 418. The aperture size can be varied from approximately 4"×9" to 2"×2.5" and preferably 4"×4" by selecting the appropriate number and orientation of longitudinally arranged members 414 and radial members 416. Further the aperture size can be varied by adding (or removing) a plurality of variable aperture straps or bands 420 that clamp around the outside of the inner drum, the aperture formed by the members 414 and 416 can be made smaller. So a 4"×4" aperture formed by member 414 and 416 can be divided approximately in half by the use of one variable aperture strap 420 placed near the mid point of the aperture on the inner drum. The aperture size is predetermined by a skilled operator that knows the types of and particle sizes of the mixed material that is to be separated into three grades by the trommel method and apparatus. In the preferred embodiment, the operator can change the aperture size of the inner drum, which is 100 mm×225 mm with no straps fitted around the barrel to 100 mm×100 mm with one strap fitted per section of the barrel, and to 100 mm×60 mm with 2 straps fitted per section of the inner drum. The determination of the aperture size would depend on the particle size desired for the material that the operator intends to have pass through the apertures in the inner drum, as well as the size of the oversize material that is not intended to pass through those apertures. The operator would open the side or top of the trommel guard 118 to access the inner drum to place the straps around it.

The inner drum barrel is open at each end so as to receive material through the inlet opening 1061 at one end and to discharge material through the outlet 1204 at the other end, with some material passing through the apertures in the inner drum 120 to the outer drum 122. The inner drum 120 further comprises an extended portion 1201, a main portion 1202 and a receiver end portion 1203. The extended portion 1201 and main portion 1202 are fastened together by any conventional means (i.e., nut 407 and bolt 406 communication through bores 408 in said components). Similarly, the main portion 1202 and the receiver end portion 1203 are fastened by any conventional means (i.e., nut 407 and bolt 406 communication through bores 408 in said components). The extended portion 1201 of the inner drum 120 is joined to the main portion along reinforcing rings 1206 and 1205. The extended portion 1201 has at its outlet end a reinforcing ring 1207 in the preferred embodiment. FIG. 3 shows part of the main portion 1202 of the inner drum 120 that is concentrically oriented inside the outer drum 122. FIG. 3 shows the extended portion 1201 that protrudes out of the outer drum. Though not specifically shown for sake of clarity, the inner drum 120 extends completely through the outer drum 122. The extended portion 1201 of the inner drum extends outside of the outer drum from the discharge openings 1062 of the outer drum 122. The sidewalls of the inner drum extended portion 1201 are over the middle grade hopper 208. The extended portion 1201 extends to its open end which discharges over the coarse grade hopper 212. A side view of the preferred embodiment would show the discharge openings 1062 of the outer drum over the middle grade hopper, as well as the side walls of the extended portion 1201 of the inner drum extending over the middle grade hopper. The outlet end of the inner drum would discharge above the oversize grade hopper 212. extended portion 1201 are over the middle grade hopper 208. The extended portion 1201 extends to its open end which discharges over the coarse grade hopper 212. A side view of the preferred embodiment would show the discharge openings 1062 of the outer drum over the middle grade hopper, as well as the side walls of the extended portion 1201 of the inner drum extending over the middle grade hopper. The outlet end of the inner drum would discharge above the oversize grade hopper 212.

A cleaner beam 404 is disposed inside the inner drum 120 (partially depicted in FIG. 3, shown complete but outside of drum in FIG. 4). The cleaner beam 404 is held by adjustable means with respect to the rotating inner drum 120 via top links 410 and the cotter pin assembly 412 at either end of the cleaner beam (only one shown in FIG. 4). Specifically the top links 410 suspend the cleaner beam 404 within the inner drum and the links are attached at one end of the trommel guard 118 and to a cross member (not shown) on the trommel guard outside of the extended portion 1201 at the other end.

Turning to FIG. 5, the outer drum 122 is formed as a spiral member 504 joined with a plurality of integrated support rods 506. Preferably the spiral member is a continuous discharge vane, commonly referred to as a chaser, that will convey middle grade material axially down the length of the outer drum. The beginning of the spiral member is at the closed end portion 1505 and the spiral runs to the discharge end of the outer drum barrel 122 at the openings 1062. In the preferred embodiment, the barrel of the outer drum is closed at the receiving end of the double skin trommel barrel and open at the discharge end. Also it is preferable to have between the discharge spiral and the inner drum some space where material in the outer drum can agitate as the trommel barrel rotates. The outside edge portions of the spiral member transition into the troughs or channels 140 within which the rollers 138 provide support for the outer drum which can rotate resting upon such rollers. In one embodiment of the invention, three (3) complete revolutions of the outer drum are required for material to make one "run" of the spiral member from beginning to end of the outer drum. The mounting plates 502 are disposed at the discharge end of the outer drum proximate to the discharge openings as shown on FIG. 5.

A plurality of roller mesh screen 124 portions (i.e., 124 shown and others not shown) are secured detachably to the outer drum 122. The mesh has openings of a second predetermined size. The screen portions are placed around the outer drum using attachment means such as the screen clamp assembly 524 or its equivalents. Specifically, a screen portion 124 is laid over the outer drum between two support rods 506. One or more screen clamp assemblies 524 are then attached to the support rod 506 as necessary to prevent the screen portion 124 from movement. In a preferred embodiment of the invention, there are nine (9) screen portions attached to and enclosing the outer drum 122. The screen mesh openings have a size predetermined to pass fines grade material, but to retain middle grade material. The roller screen mesh portions are changeable, and the operator would select mesh having openings or apertures of a size predetermined for the material to be screened out as fines from that to be separated out as middle grade.

The inner drum 120 and outer drum 122 are fastened together. Specifically, the inner drum 120 is provided with a plurality of flanges 402 and the outer drum 122 is provided with a plurality of mounting plates 502. In the preferred embodiment, the flanges 402 are on the main portion 1202 of the inner drum. The receiver end portion 1203 and the main portion 1202 of the inner drum 120 are disposed within the outer drum 122, and the flanges 402 align with the mounting plates 502 at the discharge end of the outer drum. The inner 120 and the outer drum 122 are then fastened by any conventional means (i.e., nut 302 and bolt 304 communication through bores 306 in said components). In the preferred embodiment, there are three (3) flange/mounting plate pairings 402/502 having three bores each. The open inlet end on the receiver end portion 1203 of the inner drum is preferably bolted to the closed end 1505 of the outer drum. Because material enters the outer drum only from the inner drum, the barrel of the outer drum is preferably closed against the receiving end of the double skin trommel barrel 106. At the discharge end 1052 of the double skin trommel barrel, the outer drum is open except where the mounting plates joined to the inner drum occlude the open end of the outer drum. With the drums 120 and 122 are joined in the preferred embodiment, the openings provide discharge outlets from the outer drum between the circumferential mounting points on the discharge end of the outer drum through which the middle grade material can pass from the drum into the middle grade hopper.

The drive assembly 134 comprises a sprocket 508, a pinion gear 518, a chain 516 and a hydraulic motor 520. The sprocket 508 is attached to the double skin trommel barrel 106 via conventional means (i.e., nut 510 and bolt 512 combination through bores 514 in each component). In the preferred embodiment, the receiving end of the inner drum and the closed end of outer drum are bolted to the sprocket. The pinion gear 518 is provided at an output shaft 526 of the hydraulic motor 520. The chain 516 links the pinion gear 518 to the sprocket 508. Other components such as an idler gear 522 may also be used by those skilled in the art of rotating machinery. Preferably the drive assembly 134 rotates the double skin trommel barrel at approximately 18 RPM.

In operation, mixtures of unconsolidated material having various grain and particle sizes are loaded into the hopper 102 through the reject grid 202. Any of the unconsolidated material that is too large to pass through the reject grid 202 is caught on that tipping grid. This rejected material can be tipped by the grid 202 to fall away from the hopper 102 in a pile or into an adjacent container to be carted away. For example, when operating the trommel to separate soils into three grades, the reject grid would eliminate tree stumps or large stones from entering the double skin trommel barrel. The unconsolidated material that passes through the reject grid enters the bin 128 and is fed onto the collection belt 1041 and moves to the feed conveyor 104. The unconsolidated material moves up the feed conveyor 104 to the inlet opening on the receiving end of the double skin trommel barrel 106, where it falls into the inner drum 120. As the drum barrel is rotated via the drive assembly 134, the unconsolidated material tumbles from the receiving end of the inner drum 120 to the discharge end of the double skin trommel barrel. Drum rotation is preferably counterclockwise as observed looking into the barrel 106 from the receiving end of the drum at 1051. The part of the unconsolidated material that enters the inner drum that is larger in size than the apertures 418 in the inner drum 120 stays in the inner drum, and tumbles down the inclined double skin trommel barrel 106 and exits at the outlet end of the extended portion 1201 where it discharges into the oversize hopper 212 and onto the oversize grade conveyor assembly 110. Material that is smaller than the apertures 418 in the inner drum 120 falls therethrough to the outer drum 122.

The cleaner beam 404 hangs inside the inner drum 120 to break apart and to agitate the unconsolidated material being screened therein. Also, the cleaner beam serves to keep the inner drum surface cleaned. The cleaner beam can be adjusted so that it rides close to the cylindrical wall of the inner drum, or adjusted to leave a gap between the beam and the drum wall. The operator of the trommel adjusts the gap between the cleaner beam and the inner drum, or removes the beam, depending on the character and grade of the mixture of unconsolidated material to be received in the inner drum. The material that falls through the apertures of the inner drum lands on the roller mesh screens 124 around the discharge spiral that comprises the outer drum 122. The screens separate the fines grade material, which is small in grain size than the openings in the screen mesh, from middle grade material that will remain in the outer drum. That is, the fines grade material falls through the mesh screens 124 and onto the fines grade transfer conveyor 1401 that is moving below the outer drum. The sides of the trommel guard 118 act like a funnel to direct fines material passing through the roller mesh screens down the sides of the trommel guard and onto the fines grade transfer conveyor. The fines transfer to the feedboot 1402 which channels the fines to the fines grade conveyor 216. The middle grade material that remains in the outer drum is moved to the discharge end of the outer drum 122 and to the middle grade conveyor assembly 108 via the rotating/pushing action of the spiral member 504. Middle grade material is discharged from the outer drum out the openings 1062 into the middle grade hopper, where it combines with the middle grade material that falls out of the extended portion 1201 of the inner drum. The brushes 206 serve to clean material from the mesh screens 124 as these screen panel rotate past the brushes 206 which preferably are spring-mounted to press against the screens. Additionally, the spiral member 504 gives a uniform and steady flow of material in the inner drum as that material is agitated and screened.

This invention offers the flexibility of handling and separating three grades of materials simultaneously. Additionally, the inner drum serves two functions: 1) to provide for an additional level of material screening and 2) to prevent the more delicate roller mesh screen 124 from being unduly damaged or impacted by heavy or oversize material. Therefore, it is a single unit capable of scalping, shredding, screening and stockpiling various materials such as construction wastes, aggregrates, coal, topsoil, tree bark demolition materials and the like for recycling and processing by the appropriate plant operations. Moreover, it is a completely mobile apparatus that can be outfitted with whatever additional equipment necessary for roadworthiness (i.e., handbrakes, anti-lock braking systems, lighting, crash bars, bumper and the like).

Although various embodiments which incorporate the teachings of the present invention have been shown and described in detail herein, those skilled in the art can readily devise many other varied embodiments that still incorporate these teachings.

We claim:

1. A transportable screening apparatus comprising:

a chassis;

a feed conveyor attached to said chassis;

a double skin trommel drum rotatably mounted to said chassis and having a receiving end and a discharge end, where said trommel drum is positioned at an incline having said receiving end at a height greater than said discharge end, said receiving end is positioned proximate the feed conveyor, said trommel drum comprising, a rotatably mounted outer drum having apertures disposed around an inner drum having larger apertures than said outer drum, and said outer drum further comprises a spiral member extending the length of said outer drum; and, a plurality of grade conveyors for conveying material of various grades away from said double skin trommel drum.

2. The apparatus of claim 1 wherein the inner drum further comprises:

an extended portion with an open end and joined to a main portion such that the extended portion extends outside of said outer drum.

3. The apparatus of claim 1 further comprising a cleaner beam disposed adjustably within said inner drum.

4. The apparatus of claim 1 wherein said inner drum further comprises a plurality of longitudinally arranged members crossed by a plurality of support rods to define said apertures.

5. The apparatus of claim 1 wherein said outer drum further comprises a plurality of screen portions disposed around said spiral member.

6. The apparatus of claim 1 wherein said plurality of grade conveyors further comprises a first discharge conveyor for fines grade material from said outer drum, a second discharge conveyor for middle grade material from said double skin trommel drum, and a third discharge conveyor for oversize material from said inner drum.

7. A transportable screening apparatus, comprising:

(A) a chassis;

(B) a rotatable trommel mounted to said chassis, comprising, (i) an outer drum joined to an inner drum at a receiving end;

(ii) said inner drum made of a plurality of cross-members that define apertures of a first predetermined size and having at said receiving end an inlet opening, and an outlet opening at the opposite end;

(iii)said outer drum made of mesh panels with openings of a second predetermined size, and said outer drum having a discharge end, and containing a spiral member extending the length of said outer drum for moving unconsolidated material received therein; and (iv) said receiving end mounted on said chassis at an incline with said inlet opening higher than said outlet opening of said inner drum and said discharge end of said outer drum;

(C) a feed conveyor for conveying unconsolidated material of varying size to said receiving end of said trommel; and (D) a plurality of grade conveyors comprising, (i) A first discharge conveyor for receiving fine grade material from said outer drum;

(ii) A second discharge conveyor for receiving middle grade material from said inner drum; and (iii) A third discharge conveyor for receiving oversize material.

8. A transportable screening device as in claim 7, wherein said inner drum comprises a main portion and said receiving end disposed within said outer drum and an extended portion having said outlet opening and extending outside of said outer drum.

9. A transportable screening device as in claim 7, said trommel further comprising a beam positioned longitudinally within said inner drum.

10. A transportable screening device as in claim 7, wherein said first discharge conveyor is positioned below said outer drum and proximate said feed conveyer for conveying material smaller in size than the apertures of said second predetermined size, and wherein said second discharge conveyor conveys material smaller in size that the apertures in said inner drum and is positioned proximately adjacent said discharge end, and said third discharge conveyor is at said outlet end of said inner drum for conveying material larger in size that the apertures of said first predetermined size.

* * * * *